United States Patent [19]

Seasholtz

[11] Patent Number: 5,069,391

[45] Date of Patent: Dec. 3, 1991

[54] DUAL-ACTIVATOR SAFETY SWITCH FOR LIQUID SPRAYER

[75] Inventor: Craig A. Seasholtz, Avis, Pa.

[73] Assignee: Shop Vac Corporation, Williamsport, Pa.

[21] Appl. No.: 497,424

[22] Filed: Mar. 22, 1990

[51] Int. Cl.[5] ..... B65B 11/00

[52] U.S. Cl. ..... 239/332; 239/526

[58] Field of Search ..... 239/332, 526

[56] References Cited

U.S. PATENT DOCUMENTS 4,216,911 8/1980 Huperz et al. ..... 239/526

4,802,313 2/1989 Smith ..... 239/526

*Primary Examiner*—David M. Mitchell

*Assistant Examiner*—Lesley Morris

*Attorney, Agent, or Firm*—Ostrolenk, Faber, Gerb & Soffen

[57] ABSTRACT

A liquid sprayer includes a housing with a spray outlet, an electric pump switch which is movable to operate a spray generating pump and a manual grip defined on the housing. A main switch is moveable linearly along the housing between on and off positions, which operate the electric switch to respectively cause and stop pump operation. A safety actuator is movable to block and permit movement of the main switch. The safety actuator has a grippable portion biased to extend outwardly from the housing. To operate the pump switch, a user squeezes the safety actuator into a switch on position in which the safety actuator releases blocking engagement with the main switch, and thereby allows the main switch to be moved to its on position which operates the pump switch to operate the pump.

4 Claims, 1 Drawing Sheet

DUAL-ACTIVATOR SAFETY SWITCH FOR LIQUID SPRAYER

BACKGROUND OF THE INVENTION

The present invention relates to a dual safety switch for operating the liquid pump operating switch of a liquid sprayer, and more particularly to a safety switch including sequential actuators to prevent unintended liquid spraying.

Liquid may be sprayed from an outlet spray lance connected to a pump. The pump may be employed in an apparatus which sprays liquid at high pressure, for example, for cleaning purposes. The liquid sprayed at high pressure imparts acceleration/reaction forces to the spray lance that could cause unintended movement of the lance. Further, the spray unit vibrates in use. Such movement could naturally lead to misdirection of fluid flow and possible injury to the user or someone or something in the path of spray. Furthermore, with a high pressure sprayer, as the spray is dangerous and could harm a person or object, the spray apparatus should be protected against accidental spraying.

The pump may operate continuously, and the spray may be released by opening a valve which controls flow from the pump outlet. Alternatively, the pump may be electrically operated and may be operated only when an electric switch connected to the pump is operated to the "on" condition. It is the latter case to which the invention is directed. Means are needed for assuring that the electric switch operates the pump to spray only when the user intends.

SUMMARY OF THE INVENTION

It is, therefore, an object of the invention to prevent the unintended actuation of a liquid flow enabling, pump activating switch.

A further object is to provide a liquid flow switch arrangement that can be constructed economically and operated simply.

Another object is to prevent operation of a liquid sprayer until both a safety actuator and thereafter an operating switch are operated.

The foregoing objects are realized in a preferred form of the invention comprising a two step sequential operation switch arrangement for use with a spray lance that is attached to a housing that is normally gripped by the user of the sprayer. A spray generating means, in the form of a pump, is in that housing. There is a spray outlet lance that is subject to acceleration forces caused by liquid spraying out of the spray lance outlet. The liquid is supplied to the lance from an electrically operated pump that is operated intermittently by an electric switch. The pump is in a pump housing. A manual grip on the pump housing is grasped by the user to hold the pump housing and to aim the lance outlet. The housing carries a main switch mechanically connected to operate the electric switch.

There is a safety actuator on the manual grip which, like a "dead man's switch", is first operated to enable the main switch to be operated. The safety actuator has a manually engageable portion which is normally biased to extend outwardly from the grip and is moved inward toward the grip when the grip and safety actuator are grasped during normal use of the sprayer.

The main switch is freed to be operated after the safety actuator has been operated. The main switch operates the electrical switch to the pump to permit liquid to be sprayed. The safety actuator locks the main switch in the off position unless the manually engageable portion of the actuator is moved inwardly to the grip by a user.

BRIEF DESCRIPTION OF THE DRAWINGS

The above and other objects and features of the invention are described with reference to the accompanying drawings, in which.

DESCRIPTION OF THE PREFERRED EMBODIMENTS

Figure 1:
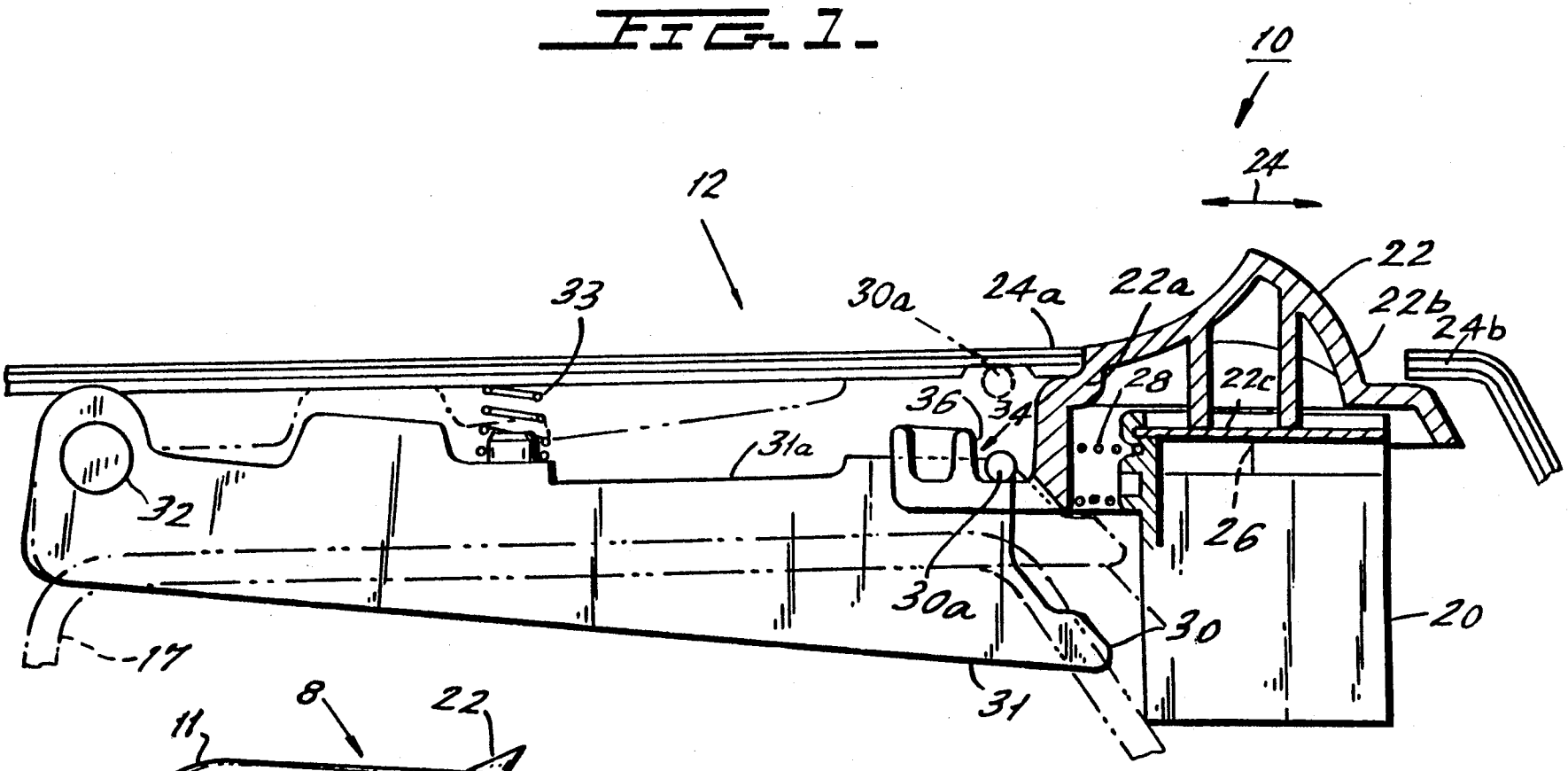
FIG. 1 is a side plan view of a dual actuator liquid flow switch arrangement in accordance with the present invention, and FIG. 2 schematically shows a sprayer using the arrangement.
Figure 2:
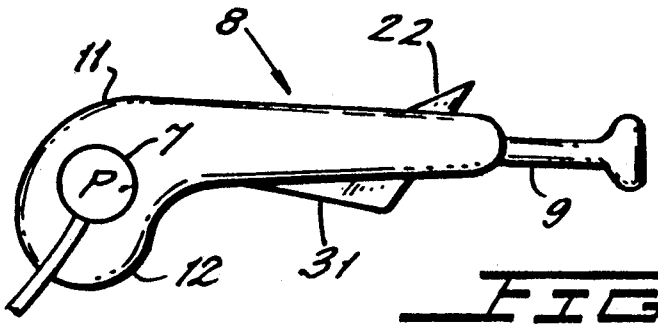

The present invention operates the electrically operated pump 7 of a high pressure liquid sprayer 8, which includes a pressure spray outlet lance 9. In such a pressure sprayer or pressure washer, the lance 9, the pump housing 11 to which the lance is attached and the grip 12 of the sprayer are subject to acceleration forces caused by the spraying of liquid. The action of the pump 7 is under the control of an electric switch shown in block form at 20. Switch 20 may comprise an electrical switch for selectively enabling electrical power to be supplied to the liquid pump 7 in the pump housing 11.

The dual actuator fluid flow switch 10 of the invention includes the manually graspable grip 12. A grip guard 17 affixed to the housing 11 extends below and is spaced from the grip 12.

A main electric switch actuator 22 for the switch 20 is located in front of the grip 12, that is closer to the spray outlet of the lance. The actuator 22 is slidable back and forth on the housing 11 in a generally linear direction, as shown by a double-headed arrow 24. The actuator 22 projects up through an opening defined between housing portions **24*a* and 24*b* of the grip. The actuator 22 is shown in an "off" position, in which an actuator end portion 22*a* is pressed to the left against the housing portion 24*a*. When the actuator 22 is moved to the right to an "on" position, the opposite actuation end portion 22*b* is pressed against the housing portion 24*b*. A lower portion 22*c* of the actuator 22 is mechanically coupled to the electric switch 20, as schematically indicated by dashed line 26. Main switch actuator 22 is normally biased to the left to the off position by a spring 28**.

Main electric switch actuator 22 cooperates with a safety actuator 30 which includes the rigid grippable arm 31. The arm 31 pivots about a grip mounted pivot 32 located at the rear end of the arm to a main actuator enabling position which is toward the grip 12, as shown in phantom lines, or to a switch blocking position away from the grip, as shown in solid lines. A spring 33 normally biases the safety actuator arm 31 into the main actuator blocking position.

The safety actuator arm 31 has an upstanding body **31*a*, which supports a pin 30*a* that extends laterally from the body 31*a* across the grip. When the grippable arm 31 is biased outward, the pin 30*a* engages the main switch actuator 22 and prevents its movement along the grip body 12. When the safety actuator arm 31 is in the switch blocking position (solid lines), the pin 30*a* is contained within a recess 34 at the rear of the main switch actuator. The rear wall 36 that defines that rear recess 34 engages the pin 30***a* if a user attempts to move the main switch actuator 22 to the right to the on position. This prevents actuation of the electric switch 20 if a user has not first grasped the grip 12 sufficiently to bring the safety actuator 30 into the operating position (phantom lines).

To enable moving the main switch actuator 22 to the on position, the arm 31 of the grip 12 must first be firmly grasped to pivot the safety actuator 30 against its normal bias and to the release position (phantom lines). This raises the pin 30*a* of the safety actuator 30 above the wall 36 and the recess 34, which disengages the pin 30*a* from the actuator 22 and enables the user to move the main actuator 22 to the right from the off to the on position. The safety actuator 30 has the benefit that the normal grasping action of the hand on the grip 12 for holding the grip and with it the whole pressure washer unit is the action that can free the main switch actuator 22. The actuator 22 is placed in front of the grip so that with the grip arm 30 being grasped, the user's thumb on the same hand can operate the actuator 22. But inadvertent operation of actuator 22 is prevented by safety actuator 30, 30*a*.

The foregoing describes a dual actuator switch arrangement that requires a user to firmly grasp a manual grip in order to permit a main switch actuator to be moved from an off to an on position.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A dual actuator safety switch arrangement for a liquid sprayer, wherein the sprayer comprises a housing having a spray outlet for spraying liquid therethrough, a spray causing switch connectable with a spray generating means for causing the generating means to pump the liquid which sprays from the outlet;

the safety switch comprising;

a manually graspable grip on the housing;

a main switch supported on the housing and movable along the housing for actuating the spray causing switch to causes liquid to spray from the spray outlet when the main switch is in an on position and to stop the liquid spray when the main switch is in an off position; and a safety actuator having a manually engageable portion normally biased to extend outwardly from the grip; the engageable portion having a main switch blocking off position outwardly of the grip and a main switch disengaging on position toward the grip;

the safety actuator including means for engaging and locking the main switch in the off position for preventing movement of the main switch to the on position when the safety actuator engageable portion is in its off position and for disengaging from and permitting the main switch to be moved to the on position when the safety actuator engageable portion is in the on position the engaging means on the safety actuator comprises a pin thereon and the main switch includes a recess defined on the main switch for receiving the pin when the safety actuator is in the off position, and the pin the recess prevents movement of the main switch from the off position to the on position and the pin is so placed that movement of the engageable portion to the on position moves the pin out of the recess.

2. The switch arrangement of claim 1, wherein the main switch is normally biased into the off position.

3. The switch arrangement of claim 2, wherein the safety actuator is pivotally attached to the housing and extends along the housing so that the engageable portion is spaced along the housing closer to the main switch than is the pivot mounting of the safety actuator.

4. The switch arrangement of claim 3, wherein the main switch is above the housing where it might be engaged by a user's thumb and the safety actuator is below the housing where it might be squeezed by the user's other fingers.

* * * * *